US005904168A

United States Patent [19]

Alulyan

[11] Patent Number: 5,904,168

[45] Date of Patent: May 18, 1999

[54] WALKER WITH AN EXPANDABLE SEAT

[76] Inventor: Moris Alulyan, 1192 N. Kingsley Dr., Los Angeles, Calif. 90029

[21] Appl. No.: 09/121,355

[22] Filed: Jul. 23, 1998

[51] Int. Cl.[6] ..... A61H 3/00

[52] U.S. Cl. ..... 135/65; 135/66; 135/67; 297/5; 297/6; 297/7; 482/68; 482/66

[58] Field of Search ..... 135/65, 66, 67; 297/5–7; 482/66, 68, 69

[56] References Cited

U.S. PATENT DOCUMENTS

| | | | |
|---|---|---|---|
| 2,708,473 | 5/1955 | Gable et al. | 135/67 |
| 2,798,533 | 7/1957 | Frank | 135/66 |
| 2,817,387 | 12/1957 | Blake | 135/67 |
| 3,354,893 | 11/1967 | Schmerl | 135/67 |
| 3,442,276 | 5/1969 | Edwards et al. | 135/66 |
| 4,180,086 | 12/1979 | Thomas | 135/67 |
| 4,643,211 | 2/1987 | Morris et al. | 135/67 |
| 4,826,240 | 5/1989 | Karpiuk | 135/67 X |
| 4,946,058 | 8/1990 | Stamm | 135/66 X |
| 5,273,063 | 12/1993 | Farr et al. | 135/66 |
| 5,785,070 | 7/1998 | Block et al. | 135/65 X |

*Primary Examiner*—Carl D. Friedman
*Assistant Examiner*—Phi Dieu Tran A
*Attorney, Agent, or Firm*—Goldstein & Canino

[57] ABSTRACT

A walker having an expandable seat adapted to accommodate users of varying body sizes to enter the walker and get in and out of the seat. The walker comprises a front cross bar having two tubular ends, and two side frames rotatably connected to each of the tubular ends of the front cross bar, so that the side frames can be rotated inward and outward with respect to the front cross bar. A telescopic upper crossbar is mounted between the side frames at the upper horizontal tubing for limiting the angular movement of the side frames when a desired position has been selected. The expandable seat includes a tubular rear end, to which a pair of seat support rods are slidably mounted. A bracket is rotatably attached to each of the sliding rods for engaging the side braces of the side frame when the seat is folded down in the horizontal position. The seat support rods can be moved in and out of the tubular rear end of the seat so that the brackets at the end thereof can be engaged with the side braces, as the distance between the rear legs is adjusted.

2 Claims, 4 Drawing Sheets

WALKER WITH AN EXPANDABLE SEAT

BACKGROUND OF THE INVENTION

This invention relates to a walker for assisting the mobility of physically disabled individuals. More particularly, the invention relates to a walker having an expandable seat to permit users of varying body sizes to enter the walker and sit conveniently on the seat.

Varieties of walkers have been proposed for assisting individuals with varying degrees of disability move from location to location. In an attempt to solve problem of frequent tiredness experienced during utilization of the walkers, several references uncovered in the prior art provide walkers having seats adapted for allowing users to rest when they become tired, such prior art walkers are disclosed in U.S. Pat. Nos. 5,133,377, 4,907,794, and 4,621,804. However, Most of these prior art walkers lack the ability to adjust the width of its seat to accommodate a user having a larger body frame. Thus, there is still a further need to provide an improved walker having an expandable seat, that enables a selective adjustment of its seat's width to permit users of various body sizes to get in and out of the seat without difficulty.

While these units mentioned above may be suitable for the particular purpose employed, or for general use, they would not be as suitable for the purposes of the present invention as disclosed hereafter.

SUMMARY OF THE INVENTION

It is an object of the invention to provide an improved walker which is capable of assisting individuals with varying degrees of disability move from location to location.

It is another object of the invention to provide a walker having an expandable seat, wherein the distance between the rear legs of the walker can be selectively adjusted to permit users of varying body sizes get in and out of the seat without difficulty.

It is yet another object of the invention to provide a walker which can be folded in a compact flat configuration for easy storage and transport purposes.

The invention is a walker having an expandable seat adapted to accommodate users of varying body sizes to enter the walker and get in and out of the seat. The walker comprises a front cross bar having two tubular ends, and two side frames rotatably connected to each of the tubular ends of the front cross bar, so that the side frames can be rotated inward and outward with respect to the front cross bar. A telescopic upper crossbar is mounted between the side frames at the upper horizontal tubing for limiting the angular movement of the side frames when a desired position has been selected. The expandable seat includes a tubular rear end, to which a pair of seat support rods are slidably mounted. A bracket is rotatably attached to each of the sliding rods for engaging the side braces of the side frame when the seat is folded down in the horizontal position. The seat support rods can be moved in and out of the tubular rear end of the seat so that the brackets at the end thereof can be engaged with the side braces, as the distance between the rear legs is adjusted.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
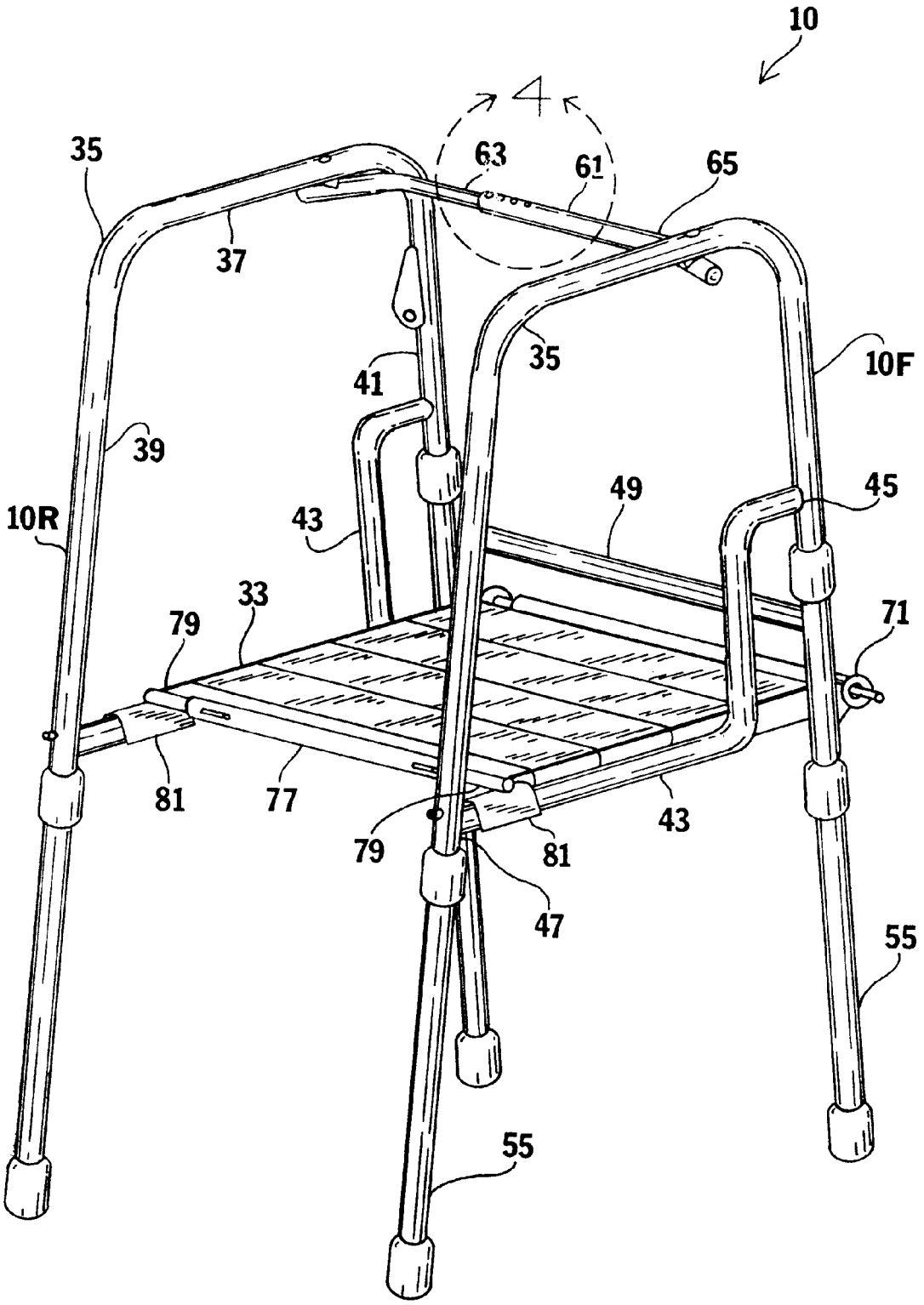
FIG. 1 is a diagrammatic perspective view of a walker of the present invention with the seat in a horizontal position.

FIG. 1 illustrates a preferred embodiment of a walker 10 in accordance with the principles of the present invention. As will be seen in following paragraph, the walker 10 of the present invention employs an expandable seat 33 designed to permit users of varying body sizes to enter the walker and get in and out of the seat. The walker 10 is of substantially open rectangular configuration and presents front 10F and rear 10R referring, respectively, to portions thereof front and rear of the user when the walker is used in a normal fashion.

Figure 3:
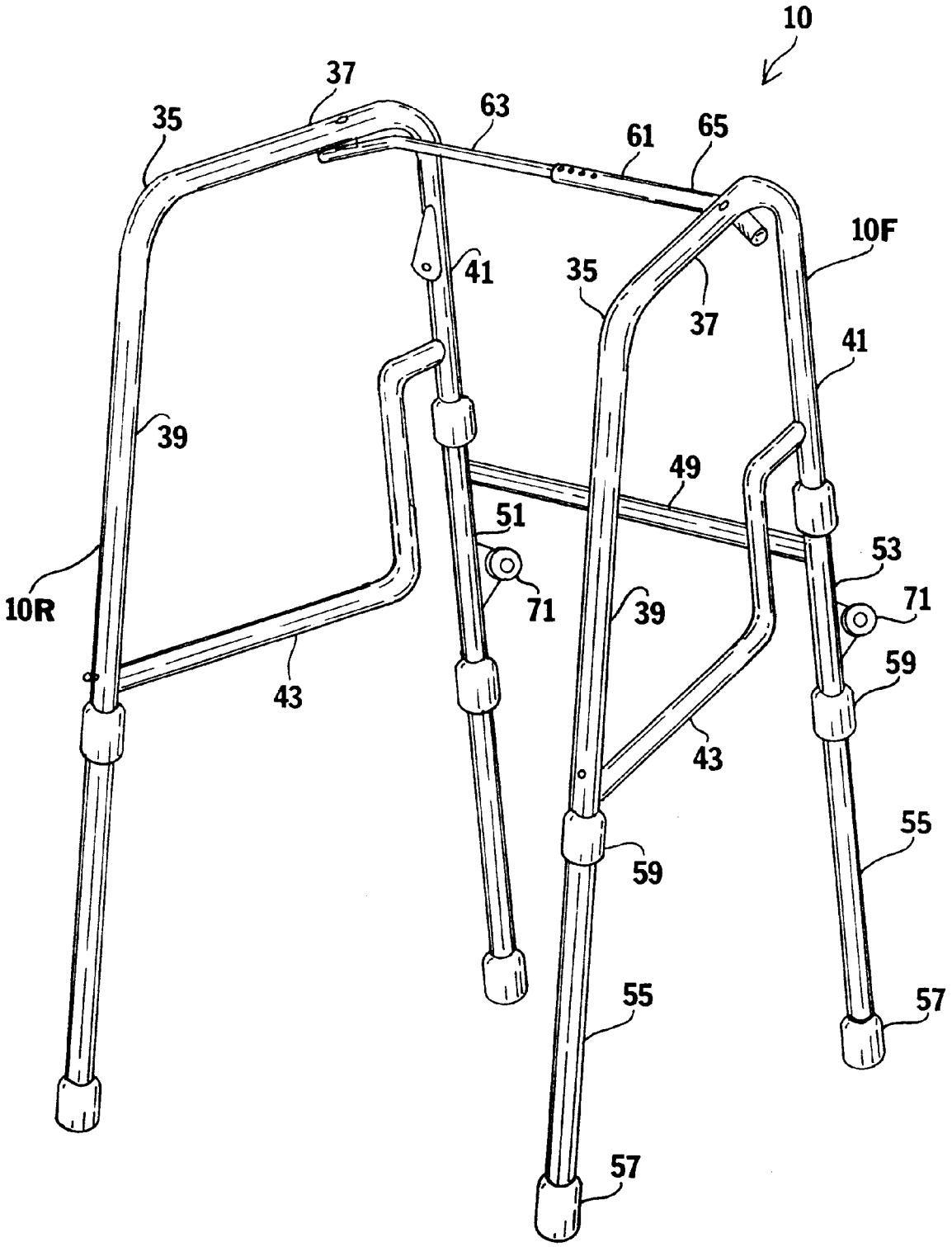
FIG. 3 is a diagrammatic perspective view of the walker with the seat detached therefrom, illustrating the distance between the rear vertical tubings thereof being selectively adjusted.

The walker 10 comprises two side frames 35 which can be constructed of hollow aluminum tubing, or any other suitable lightweight, durable material. Each of the side frames 35 includes an upper horizontal tubing 37, front 39 and rear 41 vertical tubings extending downwardly therefrom, and a side brace 43 fixedly connected between the front and rear vertical tubings. The specific attachment locations 45 and 47 and the shape of the side braces 43 are chosen to support the seat 33 at a preselected elevation when the seat is folded down in a horizontal position. Hand grips may be fixedly mounted on the periphery of the upper horizontal tubings 37 for permitting the user to comfortably grasp the walker 10 with his or her hands during use, which is not shown here. Referring to FIG. 3, the two side support frames 35 are connected by a front crossbar 49 having a first tubular end 51 rotatably attached to one of the front vertical tubings 41 and a second tubular end 53 rotatably attached to the other front vertical tubing 41. In this manner, each side frame 35 can be independently rotated with respect to the front crossbar 49 and thereby enabling the distance between rear vertical tubings 39 to be manually adjusted.

The walker 10 further comprises four telescopic legs 55 having tip cushions 57 covering the bottom ends thereof for contacting the ground, during use. Two of the telescopic legs 55 are slidably received inside the rear vertical tubings 39, and the other two telescopic legs slidably received inside the tubular ends 51 and 53 of the front crossbar 49 and the front vertical tubings 41. The combined vertical length of the telescopic parts can be adjusted to conform to the height of the user via telescopic adjustment arrangements 59.

Figure 4:
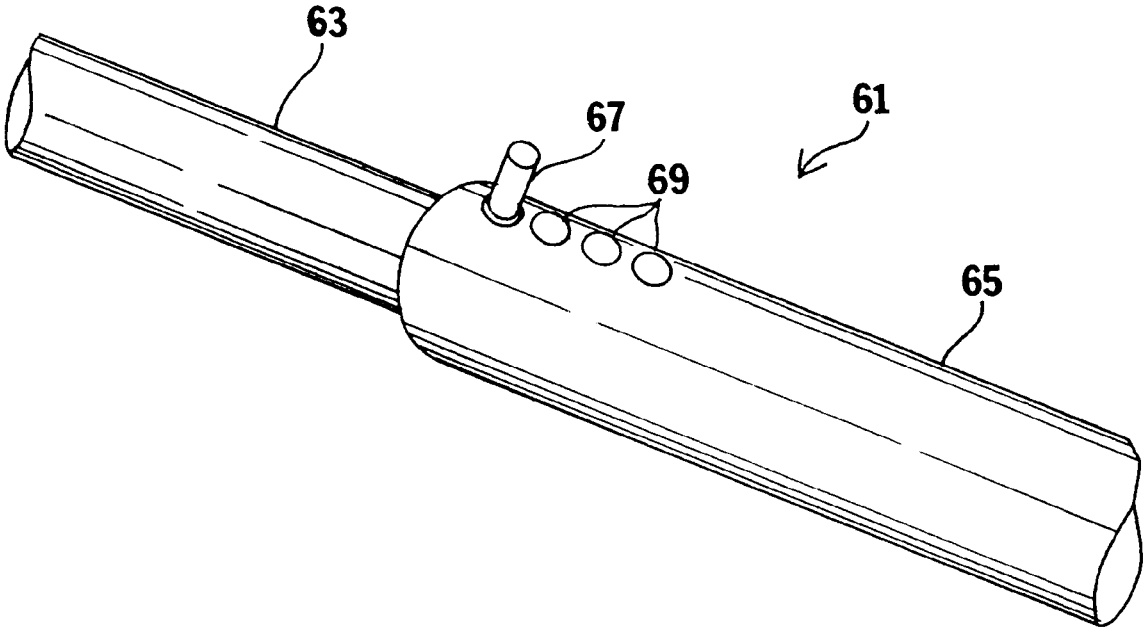
FIG. 4 is an enlarged perspective view of the area indicated in the circle 4 in FIG. 1.

One important feature of the present invention is its ability to selective adjust the distance between the rear vertical tubings 39 for permitting users of varying body sizes to get in and out of the seat 33. The selective adjustment of the walker width can be achieved with a telescopically adjustable upper crossbar 61 connected between the upper horizontal tubing 37. The upper crossbar 61 of the present invention includes first 63 and second 65 telescopic members, one sliding inside the other. The first 63 and second 65 telescopic members of the upper crossbar 61 are rotatably connected to the upper horizontal tubings 37 so that the first and second telescopic members can be maintained in a straight linear relationship, as the side frames 35 are rotated inward and outward. As seen by referring to FIG. 4, the preferred embodiment of the upper crossbar 61 employs a push-button lock mechanism 67 for selectively adjusting the length of the upper crossbar and limiting the telescopic movement of the telescopic members when a desired length is selected. The adjustment of the distance between the rear vertical tubings 39 can be achieved by first pressing the push-button lock mechanism 67 and then moving the rear vertical tubings inwardly or outwardly to a desired position. When a desired position has been selected, the push-button lock mechanism 67 is fitted through one of series of apertures 69 provided in the second telescopic member 65 to limit telescopic movement of the upper crossbar.

Figure 2:
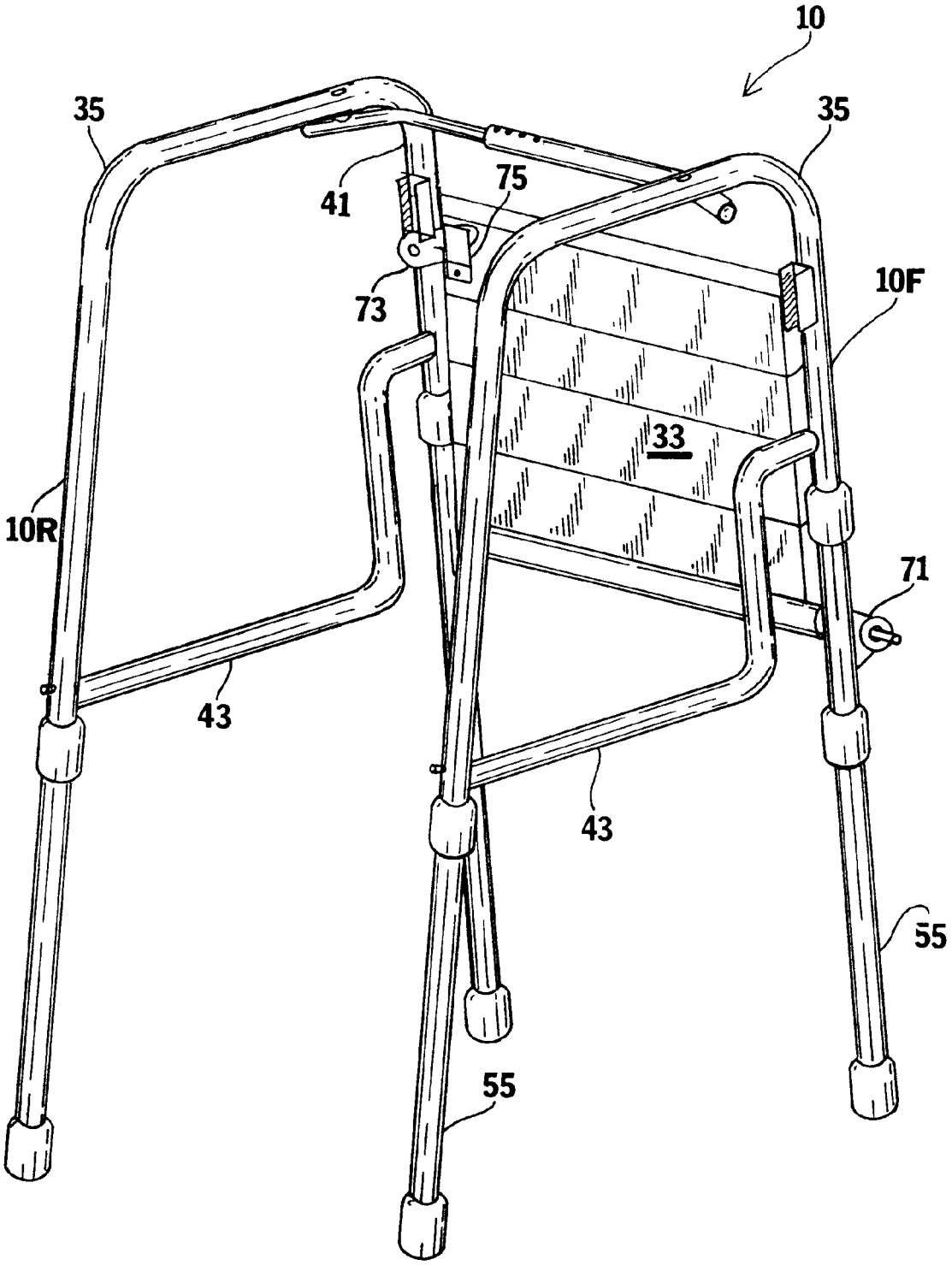
FIG. 2 is a diagrammatic perspective view of the walker with the seat in an upright position.

FIGS. 1 and 2 illustrate the seat 10 pivotally connected to the front 10F of the walker via seat holders 71. Thus, the seat 33 can be folded up in an upright position when the walker 10 is used in a normal fashion and can be folded down to rest on the side braces 43 for providing seating comfort when resting is desired. A swivel piece 73 is pivotally attached to one of the front vertical tubings 41 and a swivel piece receiving bracket 75 is mounted to the bottom side of the seat 33 for receiving the swivel piece 73 adapted to hold the seat in the upright position.

Referring back to FIG. 1, the seat 33 includes a tubular rear end 77, to which a pair of seat support rods 79 are slidably mounted. A turning bracket 81 is rotatably attached to each of the support rods 79 adapted to engage the side braces 43 when the seat is folded down in the horizontal position. A coil spring may be provided inside the tubular rear end 77 between the pair of slide rods 79 to cause the slide rods to be urged outwardly. The seat support rods 79 can be moved in and out of the tubular rear end 77 so that the brackets 81 at the end thereof can be engaged with the side braces, as the distance between the rear verrical tubes 39 is adjusted.

The ability of the walker 10 to be folded in a flat configuration is substantially improved over prior art designs, in that the side frames 35 of the present invention can be rotated inwardly with respect to the front cross bar. 49 To fold the walker in a flat configuration, the first 63 and second 65 telescopic members of the upper crossbar 61 are pulled apart from each other and rotated so that they are parallel with the upper horizontal tubings 37. The detaching of the upper crossbar 61 allows the two side support frames 35 to be folded against the front crossbar 49 and thereby achieving a substantially flat configuration for easy storage and transport purposes.

Many specific details contained in the above description merely illustrate some preferred embodiments and should not be construed as a limitation on the scope of the invention. Many other variations are possible.

What is claimed is:

1. A walker comprising:

a) a first side frame having a horizontal member, front and rear legs extending downwardly from the horizontal member, said front and rear legs being telescopically adjustable to permit overall height of the walker to be selectively adjusted to conform to a user, and a side brace connected between said front and rear legs;

b) a second side frame having a horizontal member, front and rear legs extending downwardly from the horizontal member, and a side brace connected between said front and rear legs;

c) a front crossbar having one end rotatably mounted to said front leg of said first side frame and the other end rotatably mounted to said front leg of said second side frame such that the distance between said rear legs of the first and second side frames can be varied;

d) an upper crossbar having one end pivotally connected to said horizontal member of said first side frame and the other end pivotally connected to said horizontal member of said second side frame, said upper crossbar comprising first and second telescopic members wherein one slides inside the other, each of said telescopic members rotatably connected to the horizontal members, said upper crossbar further comprising a push button lock mechanism for selectively adjusting the length of the upper crossbar and limiting the telescopic movement thereof when a desired length is selected; and e) a seat pivotally attached to said first and second side frames and movable between an upright position and a horizontal position, said seat further comprising a tubular rear end, to which a pair of seat support rods are slidably mounted, and a turning bracket rotatably attached to each of said sliding rods adapted to engage the side braces when the seat is folded down in the horizontal position;

f) side braces, connected between the front and rear legs, having attachment locations and shapes selected to support the seat at a preselected elevation when the seat is folded down in the horizontal position.

2. The walker as recited in claim 1, further comprising a swivel piece pivotally attached to one of the front legs and a swivel piece receiving bracket mounted to the bottom side of the seat for receiving the swivel piece adapted to hold the seat in the upright position.

* * * * *